US005588064A

United States Patent [19]

McSwiggen et al.

[11] Patent Number: 5,588,064

[45] Date of Patent: Dec. 24, 1996

[54] HEARING AID BATTERY COVER SWITCH

[75] Inventors: John P. McSwiggen, Inver Grove Heights; Randall W. Roberts, Eden Prairie, both of Minn.

[73] Assignee: Wilbrecht Electronics, Inc., St. Paul, Minn.

[21] Appl. No.: 586,212

[22] Filed: Jan. 16, 1996

[51] Int. Cl.[6] ..... H04R 25/00

[52] U.S. Cl. ..... 381/69.2; 381/68.6; 381/69

[58] Field of Search ..... 381/69.2, 69, 68, 381/68.6, 68.7; 429/98, 100, 123, 96; 181/129, 130

[56] References Cited

U.S. PATENT DOCUMENTS 4,803,458 2/1989 Trine et al. ..... 338/198
4,947,439 8/1990 Buettner ..... 381/69.2

FOREIGN PATENT DOCUMENTS 0667766 10/1988 Switzerland ..... 381/68.6

*Primary Examiner*—Sinh Tran
*Attorney, Agent, or Firm*—Moore & Hansen

[57] ABSTRACT

A hearing aid battery cover switch for a hearing aid, having a shorting contact mounted to the battery cover for actuation of various modes of a hearing aid by a user. A contact member is positioned to be engaged by the shorting contact when the contact is moved by a user. Various switch designs are used, including a cantilevered contact switch, a symmetrical wave spring switch, and a cantilevered switch with a battery contact post.

13 Claims, 2 Drawing Sheets

HEARING AID BATTERY COVER SWITCH

BACKGROUND OF THE INVENTION

The present invention relates generally to the field of hearing aids. More specifically, it relates to switches used in hearing aids.

Hearing aid technology continues to strive toward smaller units and therefore smaller components. As the size of hearing aid units decreases, the area in which to place components also decreases. Further, with the advent of in-the-canal and completely in-the-canal hearing aids, the available surface area for controls used during normal operation of the hearing aid has further decreased. Consequently, space considerations can dominate the designs of such units, especially for in-the-canal and completely in-the-canal units. Often, hearing aids are programmed with several programs, corresponding to conditions encountered during a normal day. For example, listening conditions in an outdoor setting with a large amount of background noise may require a different frequency response for the hearing aid than the situation of a private conversation in a quiet room. For this reason, hearing aids are often programmed with several different modes that the user can select depending upon the conditions.

For in-the-canal and especially completely in-the-canal hearing aids, a very small useable surface area for controls creates the need to maximize efficiency of those controls. A selector switch control to change between hearing aid modes is necessary in order to provide a user friendly unit. Other items required to be on the face of the unit are, generally, a volume control and a battery cover. The battery cover often uses a substantial portion of the surface area due to the size of the battery.

It would be desirable to be able to combine several controls or required items into one area of the hearing aid usable surface. Such a combination would increase the allowable surface area for other features of a unit.

SUMMARY OF THE INVENTION

The present invention combines the battery cover of a hearing aid unit with a momentary switch that may be used to select from multiple modes or programs of a hearing aid. The present invention is readily adaptable for use on a wide variety of hearing aids, especially such as that disclosed in U.S. Pat. No. 4,803,458 which is hereby incorporated by reference. A typical battery cover has a generally semi-circular interior shape, and is pivotally attached to the main hearing aid housing. When such a cover is rotated to its open position, a battery may be inserted into the semi-circular opening, and the battery cover and battery rotated into position to seat the battery in a proper position. The battery cover usually has a lip which allows the user to open the battery cover by using a fingernail or similar object.

The present invention mounts a flexible shorting bar cantileverly to the battery cover. This flexible shorting bar extends to a position slightly beyond the extent of the battery cover, and may be depressed by a user to contact wire leads, allowing a circuit to be completed and various modes selected by the user. Such a shorting bar is known to the art. However, the placement of the shorting bar externally to the structure of the heating aid, in combination with the battery cover switch, provides the benefit of multiple use of one area of the limited available surface of the heating aid unit.

The shorting bar is cantilevered, the fixed end being attached to the battery cover. The shorting bar is flexible, and its non-mounted end is positioned above the wire leads that will complete the circuit upon contact with the shorting bar. When the shorting bar is depressed, it makes momentary contact with the wire leads, thereby electrically actuating a desired mode of operation. Because of the tension placed in the bar when it is depressed, the shorting bar returns to its original position upon release.

Alternative contacts will allow the wire leads to be reduced in number or even eliminated. A battery contact tab on the shorting bar will directly contact the battery, eliminating the need for the extra contacts. Also, the shorting contact may be formed such that a depression of the contact by a user results in internal contact between the contact and the battery.

These and other benefits of the present invention will become apparent from the following detailed description thereof taken in conjunction with the accompanying drawings.

DESCRIPTION OF THE PREFERRED EMBODIMENT

Figure 1:
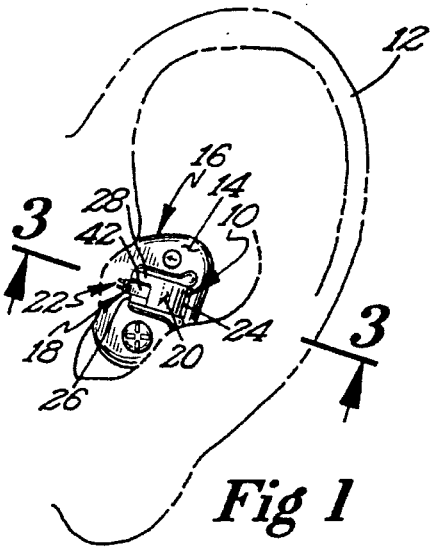
FIG. 1 is a perspective view of a heating aid showing an embodiment of the battery cover switch of the present invention.

Referring to FIG. 1, the battery cover switch 10 may be seen in place on an in-the-canal hearing aid 16 in an ear 12. Battery cover switch 10 is located on the surface plate or faceplate 14 of hearing aid 16. Shorting contact bar 18 is cantileverly mounted to battery cover 20, and may be moved from a first, normal or rest position to a second, contact position when depressed by a user to touch contact member 22 which is shown as a pair of wire leads 36, 37.

A microphone, speaker, and amplifier are within the body of heating aid 16, in arrangements such as those disclosed in U.S. Pat. No. 4,803,458.

Figure 2:
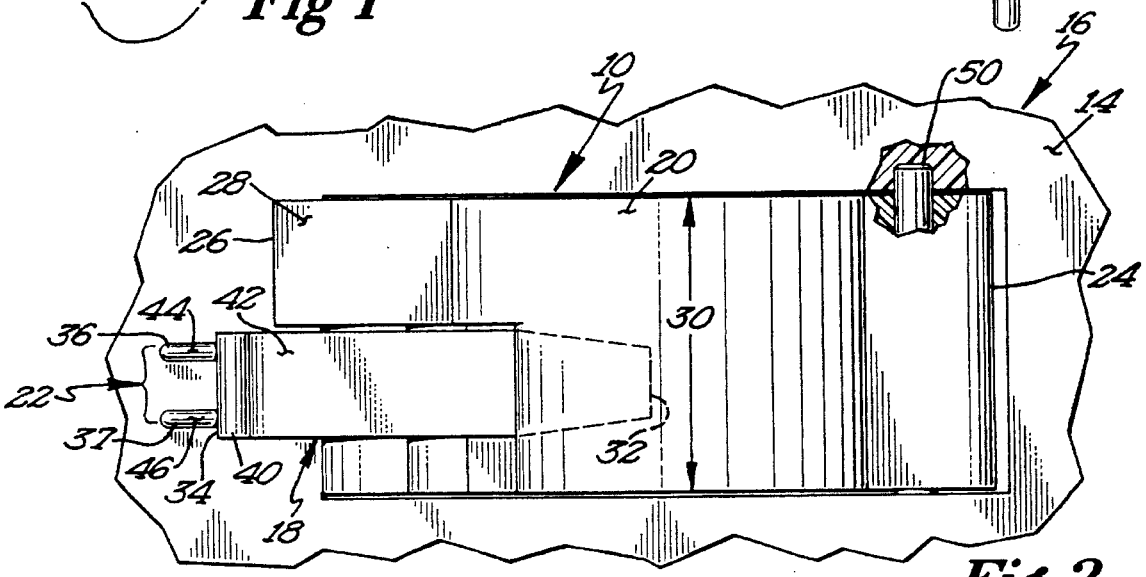
FIG. 2 is a top view of the surface plate or faceplate of the embodiment shown in FIG. 1.

Opening extension 28 allows battery cover 20 to be opened by a user inserting a finger nail or similar object into gap 48 formed between opening extension 28 and surface plate 14 of hearing aid 16 and exerting upward pressure. Battery cover 20 is pivotally mounted in surface plate 14 by pivot pin 50. Referring now to FIG. 2, battery cover switch 10 may be seen in greater detail. Battery cover 20 is pivotally mounted to surface plate 14 at end 24 so that it may rotate in a rotation plane perpendicular to surface plate 14 and also to pivot pin 50. At opposite end 26 of battery cover 20, opening extension 28 may be used to open battery cover 20 to insert, replace, or remove a hearing aid battery 29. Opening extension 28 extends for approximately half of the width 30 of battery cover 20.

Figure 4:
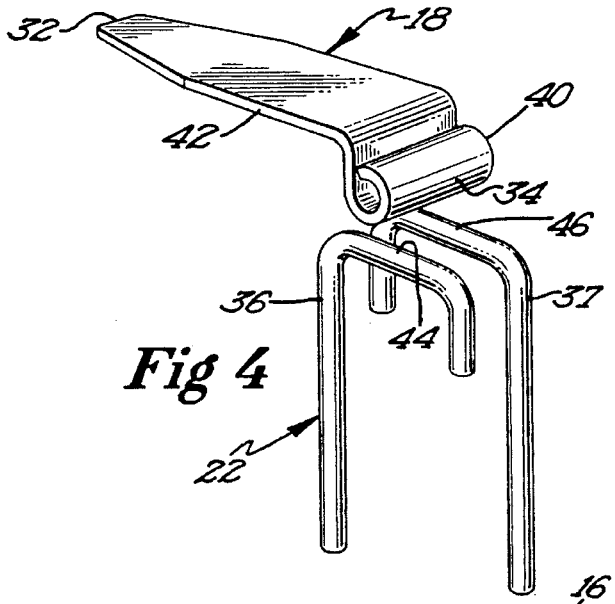
FIG. 4 is a perspective view of the shorting bar and wire leads of the embodiment shown in FIG. 1.

Shorting bar 18 is mounted at its end 32 to battery cover 20 by insertion of end 32 into mounting slot 38 of battery cover 20. Opposite end 34 of shorting bar 18 extends beyond the end 26 and structural periphery of battery cover 20, and is positioned above, and in juxtaposition for contact with, contact member 22, shown in FIG. 2 in its preferred form of two wire leads 36 and 37. Shorting bar 18 is flexible and conductive, and preferably takes the form of a thin, flat metal strip as shown most clearly in FIG. 4. A beryllium-copper alloy is the preferred metal for shorting bar 18. This alloy may be heat treated to provide flexibility. Other metals could also be used for shorting bar 18.

Figure 3:
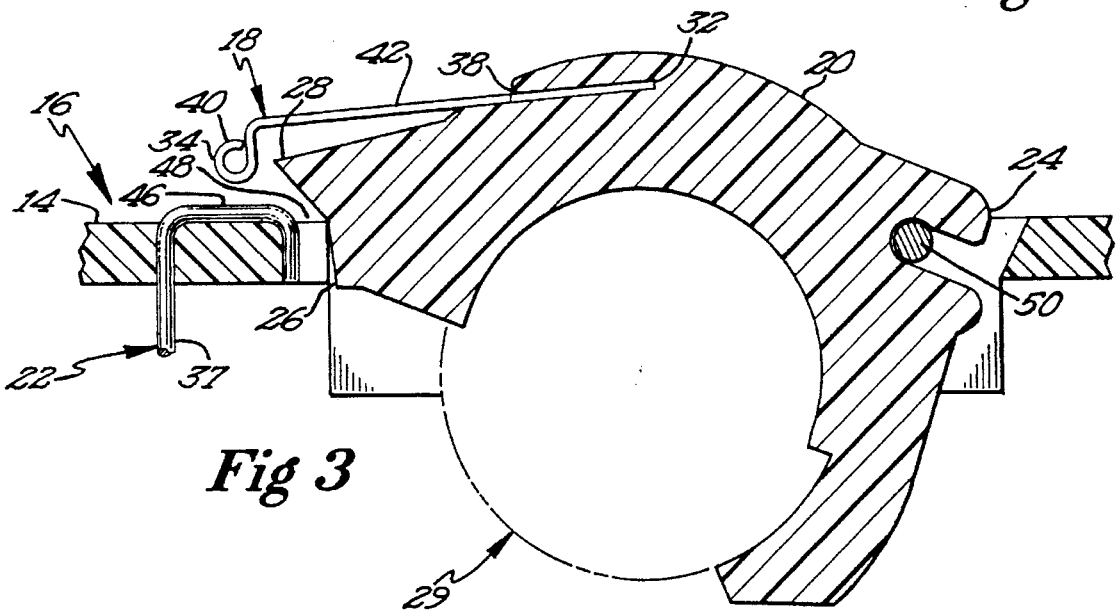
FIG. 3 is a section view of the heating aid embodiment shown in FIG. 1 taken along lines 3—3 thereof.

Referring now also to FIG. 3, the cantilevered mounting of shorting bar 18 to the battery cover 20 may be seen in detail. End 32 of shorting bar 18 fits into mounting slot 38 of battery cover 20. Shorting bar 18 may be glued or otherwise fixed within slot 38 in order to assure it will remain in proper position. End 34 of shorting bar 18 has contact segment 40 extending substantially perpendicularly to the main body 42 of mounting bar 18. Contact segment 40 allows good contact with contact member 22 when shorting contact 18 is depressed by a user. Flexible shorting bar 18 is movable in the rotation plane of battery cover 20 between its first, normal position to its second, depressed contact position.

Contact member 22 and specifically wire lead 37 may also be seen in FIG. 3. Wire leads 36 and 37 have contact surfaces 44 and 46 respectively, which are positioned above surface plate 14 of hearing aid 16. Contact segment 40 of shorting bar 18 momentarily contacts surfaces 44 and 46 when it is depressed by a user. Wire leads 36 and 37 attach to appropriate leads for completing an electrical circuit and controlling the appropriate functions of the hearing aid 16. The electrical circuit with the hearing aid responds to the momentary contact of shorting bar 18 with a step function or a ramping function that actuates the various modes of the hearing aid 16. Upon release of pressure on shorting bar 18 by the user, the spring force in bar 18 and its cantilevered mounting will return bar 18 to its first, normal position.

Figure 5:
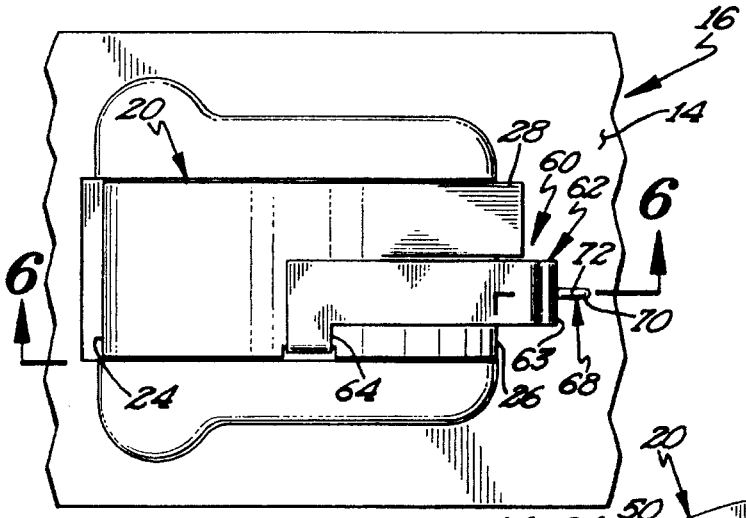
FIG. 5 is a top view of an alternative embodiment of the battery cover switch of the present invention.
Figure 6:
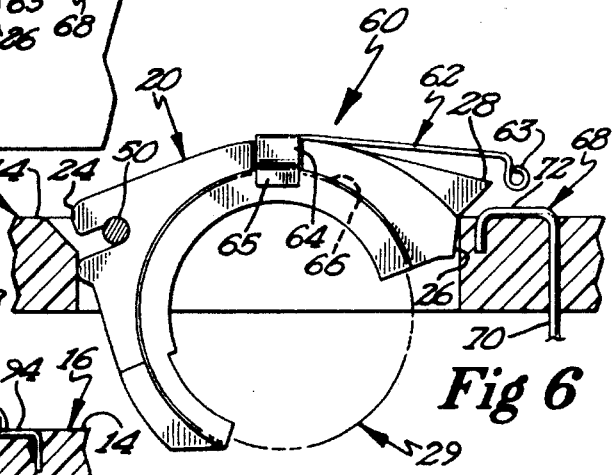
FIG. 6 is a section view of the embodiment shown in FIG. 5 taken along lines 6—6 thereof.

An alternative embodiment of the battery cover switch designated as reference numeral 60 is shown in FIGS. 5 and 6. Alternative shorting contact 62 is mounted to battery cover 20 by attachment clip 64 placed at one end of alternative shorting contact 62. The opposite end 63 of alternative shorting contact 62 extends beyond end 26 of battery cover 20 to a position in which it will be able to touch contact surface 72 of single wire lead 70 imbedded in surface plate 14 of heating aid 16 in the same way as contact member 22 is imbedded in surface plate 14. Attachment clip 64 clips alternative shorting contact 62 onto battery cover 20, and also forms a battery contact tab 65. Attachment clip 64 eliminates the need for one of the wire leads present in the first embodiment of the battery cover switch 10 by extending to form a direct electrical contact with the cylindrical side wall 66 (positive terminal) of battery 29. Therefore, alternative contact member 68 needs only one wire lead 70. Wire lead 70 has contact surface 72 that end 63 of alternative contact member 62 will touch when it is depressed by a user, completing an electrical circuit to control appropriate functions of hearing aid 16. The remaining features of the battery cover switch 60 are substantially the same as battery cover switch 10.

Figure 7:
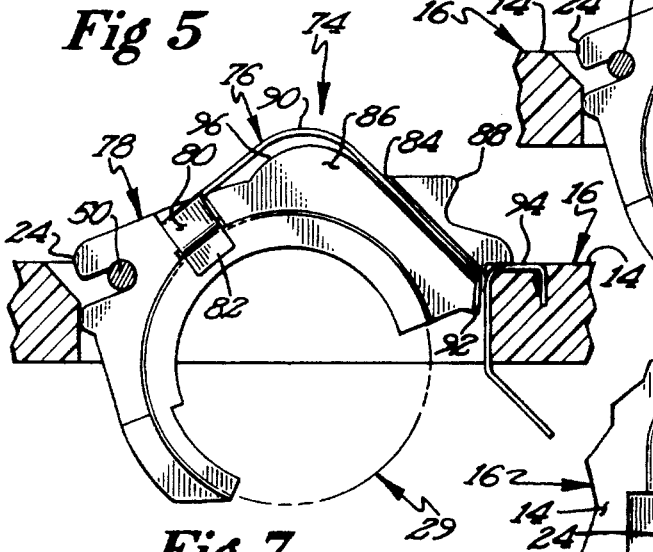
FIG. 7 is a side view of another alternative embodiment of the battery cover switch of the present invention.

Another alternative embodiment of the battery cover switch designated as reference numeral 74 is shown in FIG. 7. In this embodiment, alternative shorting contact 76 has the form of a symmetrical wave spring, or of one leaf of a leaf spring. Shorting contact 76 clips at one end to alterative battery cover 78 in the same fashion as shorting contact 62 clips to battery cover 20. An attachment clip 80 with battery contact tab 82 mounts alternative shorting contact 76 to alternative battery cover 78. Alternative battery cover 78 has a shorting contact slot 84 formed between its body 86 and its opening extension 88. Shorting contact 76 has a vertex 90 between attachment clip 80 and opposite end 92. The portion of shorting contact 76 between vertex 90 and opposite end 92 fits into shorting contact slot 84. Opposite end 92 extends beyond shorting contact slot 84 to nearly touch contact member 94 placed within surface plate or faceplate 14 of heating aid 16. Contact member 94 within surface plate 14 does not extend above the surface plate 14, since the opposite end 92 of alternative shorting contact 76 will touch contact member below surface plate 14. Cover 78 further has a switch contact stop 96 positioned below vertex 90 to stop downward motion of shorting contact 76 when it is depressed by a user from its first normal position to a second, contact position. In this embodiment, most of shorting contact 76 is protected and covered by the material of opening extension 28 and the material of alternative cover 78 over slot 84. Contact with contact member 94 by shorting contact 76 completes an electrical circuit to control the appropriate functions of hearing aid 16. Upon release of pressure by the user, the spring force of the contact 76 will allow it to return to its first, rest position.

Figure 8:
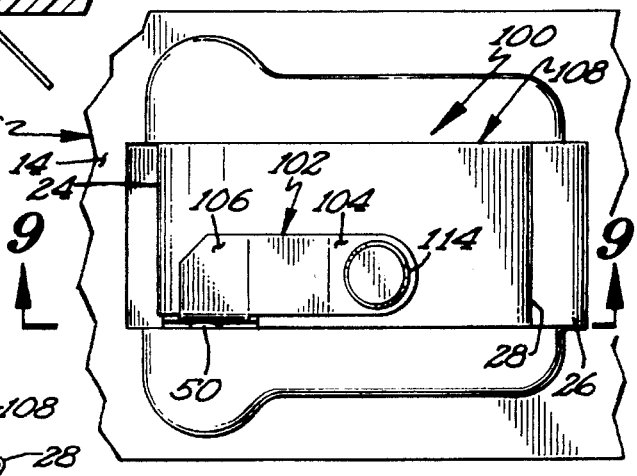
FIG. 8 is a top view of a third alternative embodiment of the battery cover switch of the present invention.
Figure 9:
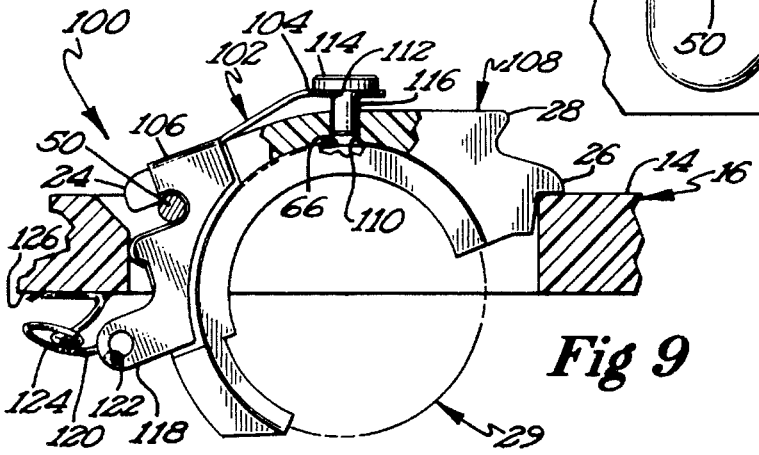
FIG. 9 is a section view of the embodiment of FIG. 8 taken along lines 9—9 thereof.

Yet another alternative embodiment of the battery cover switch is designated as reference numeral 100 and is shown in FIGS. 8 and 9. In this embodiment, yet another alternative shorting contact 102 is shown. Shorting contact 102 includes a cantilevered contact arm 104 which extends from main body 106 to a position above alternative battery cover 108. Contact arm 104 has an opening 112 through which a contact post 114 is placed. Contact post 114 may be affixed to contact arm 104 by soldering or other suitable means. Alternative battery cover 108 has an opening 110. Contact post 114 has a shaft 116 that extends through opening 110 of alternative battery cover 108 and which will contact sidewall 66 of battery 29 when contact arm 104 is depressed by a user. Main body 106 of shorting contact 102 is shaped to fit the side contour of alternative battery cover 108, that is, to extend along the contour of battery cover 108, avoiding the contact pin 50.

The shape of main body 106 is best shown in FIG. 9. Main body 106 is affixed to alternative battery cover 108, and extends around pivot pin 50 to the interior cavity of the heating aid 16. The main body 106 is connected by wire 120 directly to the appropriate inner circuitry of hearing aid 16 by solder 122 at attachment tab 118, eliminating the need for a contact member such as those used in other embodiments. The contact in this embodiment is nearly fully protected by the hearing aid body, and is largely internal to the heating aid 16.

In this embodiment, the wire 120 soldered to attachment tab 118 must flex enough to allow removal of the battery 29 from battery cover 108. To allow this flexure, a loop 124 of wire 120 is glued to the back 126 of surface plate or faceplate 14, as shown in FIG. 9. Contact arm 104 may be depressed by a user from its first, normal position to a second contact position in which a shaft 116 of contact post 114 contact battery 29, completing an electrical circuit for operation of the functions of hearing aid 16.

When heating aid 16 is in use, it will be in placed in the ear 12 of the user. Various programmed modes may be selected by the user by simply depressing and releasing the appropriate shorting contact, thereby completing an electrical circuit and changing modes.

The detailed description outlined above is considered to be illustrative only of the principles of the invention. Numerous changes and modifications will occur to those skilled in the art, and there is no intention to restrict the scope of the invention to the detailed description. The preferred embodiments of the invention having been described in detail the scope of the invention should be defined by the following claims.

What is claimed is:

1. A battery cover switch for a hearing aid, comprising:

a battery cover pivotally attachable to the hearing aid;

a shorting contact cantileverly mounted to said battery cover and movable between a first, rest position and a second, contact position, said shorting contact comprising:

a flexible contact arm affixed at one end thereof to said battery cover and having an opposite, free, contact end disposed beyond the structural periphery of said battery cover in contacting juxtaposition to a contact member;

said contact member positioned to be touched by said shorting contact when said shorting contact is moved from said first, rest position to said second contact position.

2. A battery cover switch as described in claim 1, wherein said contact member comprises a pair of spaced apart wire leads.

3. A battery cover switch as described in claim 1, wherein said shorting contact is mounted for motion in the rotation plane of said battery cover.

4. A battery cover switch as described in claim 1, wherein said shorting contact is approximately one-half the width of said battery cover.

5. A battery cover switch as described in claim 1, wherein said shorting contact is a beryllium-copper alloy.

6. A battery cover switch for a hearing aid, comprising:

a battery cover pivotally attachable to the hearing aid;

a shorting contact mounted to said battery cover and movable between a first, rest position and a second, contact position, said shorting contact comprising a contact arm and an attachment clip for mounting said contact arm to said battery cover, said attachment clip having a battery contact tab extending therefrom, said battery contact tab capable of making electric contact with a heating aid battery when said battery cover is closed; and a contact member positioned to be touched by said shorting contact when said shorting contact is moved from said first, rest position to said second contact position;

wherein when said shorting contact is moved from said first rest position to said second contact position, an electrical circuit is completed.

7. A battery cover switch for a hearing aid, comprising:

a battery cover pivotally attachable to the hearing aid;

a shorting contact mounted to said battery cover and movable between a first, rest position and a second, contact position, wherein said shorting contact comprises a symmetrical wave spring having an attachment clip for mounting said symmetrical wave spring to said battery cover, said attachment clip further having a battery cover-contact tab extending therefrom and capable of contacting a battery when said battery cover is closed; and a contact member positioned to be touched by said shorting contact when said shorting contact is moved from said first, rest position to said second contact position;

wherein when said shorting contact is moved from said first rest position to said second contact position, an electrical circuit is completed.

8. A battery cover switch as described in claim 7, wherein said battery cover includes a shorting contact slot through which a portion of sais symmetrical valve spring may be placed to protect said shorting contact from exposure.

9. A battery cover switch as described in claim 7, wherein;

said symmetrical wave spring has a vertex; and said battery cover includes a switch contact stop extending upward from the top of said battery cover, said switch contact stop positioned beneath said vertex of said symmetrical wave spring, wherein said switch contact stop serves to limit the motion of said shorting contact.

10. A battery cover switch for a hearing aid, comprising:

a battery cover pivotally attachable to the hearing aid;

a shorting contact mounted to said battery cover and movable between a first, rest position and a second, contact position, wherein said shorting contact comprises a cantilevered contact arm and a contact post attached to the distal end of said contact arm; and said battery cover includes an opening through which said contact post travels when said shorting contact is moved from said first rest position to said second contact position, said contact post capable of contacting a battery within the heating aid;

a contact member positioned to be touched by said shorting contact when said shorting contact is moved from said first, rest position to said second contact position;

said shorting contact further comprising a main body affixed to said battery cover, said main body electrically contactable to inner-circuitry of the hearing aid.

11. A battery cover switch as described in claim 10 and further comprising:

a connection wire electrically connected with said main body, said connection wire having a loop of wire glued to said heating aid to allow flexure when said battery cover is opened.

12. A hearing aid assembly to be inserted within an ear of a user, said hearing aid assembly comprising:

a housing having a faceplate region;

a microphone;

an amplifier electrically connected to said microphone;

a speaker electrically connected to said amplifier;

a battery cover pivotally mounted on said faceplate region, said battery cover being shaped to define a cavity capable of holding a battery;

a shorting contact cantileverly mounted to said battery cover and movable between a rest position and a depressed contact position; and a contact member extending to just above said faceplate region and positioned to be touched by said shorting contact when said shorting contact is depressed to said contact position.

13. A hearing aid assembly as described in claim 12, wherein said shorting contact comprises contact arm affixed at one end to said battery cover, and having an opposite, free, contact end disposed beyond the structural periphery of said battery cover, in juxtaposition to be contacted by said contact member.

* * * * *